US005638022A

United States Patent [19]

Eatwell

[11] Patent Number: 5,638,022

[45] Date of Patent: Jun. 10, 1997

[54] CONTROL SYSTEM FOR PERIODIC DISTURBANCES

[75] Inventor: Graham P. Eatwell, Caldecote, England

[73] Assignee: Noise Cancellation Technologies, Inc., Linthicum, Md.

[21] Appl. No.: 347,421

[22] PCT Filed: Jun. 25, 1992

[86] PCT No.: PCT/US92/05229

§ 371 Date: Dec. 2, 1994

§ 102(e) Date: Dec. 2, 1994

[87] PCT Pub. No.: WO94/00930

PCT Pub. Date: Jan. 6, 1994

[51] Int. Cl.[6] ..... G10K 11/16

[52] U.S. Cl. ..... 327/551; 327/317; 327/552; 381/71

[58] Field of Search ..... 327/317, 355, 327/551, 552; 381/71, 94

[56] References Cited

U.S. PATENT DOCUMENTS

| | | | |
|---|---|---|---|
| 3,132,339 | 5/1964 | Boughnou | 327/551 |
| 3,979,682 | 9/1976 | Warwick | 327/361 |
| 4,449,235 | 5/1984 | Swigert . | |
| 4,589,136 | 5/1986 | Poldy et al. . | |
| 4,837,834 | 6/1989 | Allie . | |

FOREIGN PATENT DOCUMENTS

| | | | |
|---|---|---|---|
| 3-10297 | 1/1991 | Japan . | |
| WO 86/03354 | 6/1986 | WIPO . | |
| WO 01/06148 | 5/1991 | WIPO | 327/551 |

OTHER PUBLICATIONS

Widrow and Stearns, "Adaptive Signal Processing,", 1985, pp. 294–301.

Castro et al., IBM Technical Disclosure Bulletin — "Time Domain Adjustable Eualizer", Oct./1977, pp. 1705–1706.

*Primary Examiner*—Terry Cunningham
*Attorney, Agent, or Firm*—Renee Michelle Larson

[57] ABSTRACT

A control system for controlling periodic disturbances employing a delayed inverse filter (5), a variable delay (6), a controller, a system model (4) and a comb filter (9).

17 Claims, 8 Drawing Sheets

CONTROL SYSTEM FOR PERIODIC DISTURBANCES

This invention relates to a control system for canceling periodic or nearly periodic disturbances. Features of this control system include a delayed inverse filter, a variable delay and, optionally, a comb filter. Unlike previous systems, little or no adaption is required and, since the system is based in the time domain rather than the frequency domain, the computation required does not increase with the number of harmonics to be controlled.

The control system has many applications including the active control of sound and vibration and the selective removal of periodic noise in communications signals.

BACKGROUND

The principle of reducing unwanted disturbance by generating a disturbance with the opposite phase is well documented. The technique is often referred to as active control to distinguish from passive control where the elements of the system are incapable of generating disturbances. Nelson and Elliot, "*Active Control of Sound*", Academic Press (1992) review some of the work done to date.

The earliest technique in this field was done by P. Lueg who described an actuator and sensor coupled by a simple negative feedback loop in U.S. Pat. No. 2,043,416.

The main shortcoming of this system is that the disturbance can only be reduced over a limited range of low frequencies. This is because of the finite response time of the control system (the time taken for a signal sent to the actuator to cause a response at the sensor). The control loop cannot compensate for the phase shifts associated with this delay, and so only operates at low frequencies where the phase shifts are small. The gain of the feedback loop must be low at other frequencies to maintain the stability of the system. This is achieved by incorporating a low pass filter into the loop—which introduces additional delay.

The range of applicability of active control systems has been extended by the use of more modern adaptive control techniques such as those described by B. Widrow and S. D. Stearns in "*Adaptive Signal Processing*", Prentice Hall (1985). In U.S. Pat. No. 5,105,377, Ziegler achieves feedback system stability by use of a compensation filter but the digital filter must still try to compensate for the phase characteristics of the system. This is not possible in general, but when the disturbance has a limited frequency bandwidth the digital filter can be adapted to have approximately the right phase characteristic at the frequencies of interest. The filter characteristic therefore depends on the disturbance as well as the system to be controlled and must be changed as the noise changes.

One class of disturbances for which this approach can be successful is periodic disturbances. These are characterized by a fundamental period, a time over which the disturbance repeats itself. Disturbances are not often exactly periodic, but any disturbance where the period changes over a timescale longer than that over which the disturbance itself changes can be included in this class.

Several approaches have been put forth for controlling periodic disturbances including that described by C. Ross in U.S. Pat. No. 4,480,333. The patent describes a feedforward control system in which a tachometer signal is fed through an adaptive digital filter. There is no description of the form of the tachometer signal but it contains no information on the amplitude of the disturbance to be controlled and thus the filter must again be adapted in response to the disturbance.

Chaplin et al, in U.S. Pat. No. 4,153,815, describe the method of wave form synthesis, where a model of one cycle of the desired control signal is stored and then sent repetitively to the actuator. Nelson and Elliot, infra, describe the equivalence of these two approaches in the special case where the period remains constant.

In U.S. Pat. No. 4,490,841, Chaplin et al recognize the benefit of splitting the stored waveform into its frequency components. The advantage of this step is that each frequency component can be adapted independently. This can improve the ability of the system to adapt to rapidly changing disturbances and can reduce the computational requirements associated with this adaption. Others have recognized this technique such as Swinbanks in U.S. Pat. No. 4,423,289 which describes the use of Frequency Sampling Filters and the equivalence of time or frequency domain weights.

In all of the above systems the filters have to be adjusted to cope with changing disturbances. This requires processing power and so adds costs to the control system. In addition, all of the systems above become increasingly complicated as the number of harmonics in the disturbance increase. This is a problem for disturbances which are impulsive in nature—such as the sound from the exhaust or inlet of an internal combustion engine.

Accordingly, it is an object of this invention to provide a control system for periodic disturbances that requires little or no adaption.

Another object of this invention is to provide a control system based in the time domain for canceling periodic disturbances.

A further object of this invention is to provide a unique system for controlling the cancellation of periodic disturbances wherein the amount of computation required does not increase with the number of harmonics to be controlled.

These and other objects of this invention will become apparent when reference is had to the accompanying drawings in which FIG. 1 is a diagrammatic view of the basic control system, FIG. 2 is a diagrammatic view of a recursive comb filter, FIG. 3 is a diagrammatic view of a comb filter configuration, FIG. 4 is a diagrammatic view of a control system, FIG. 5 is a diagrammatic view of a combined system, FIG. 6 is a diagrammatic view of the adaption of a delayed inverse filter, FIG. 7 is a diagrammatic view of the identification of model filter A, FIG. 8 is a view of an off-line adaption of delayed inverse, FIG. 9 is a diagrammatic view of a system with on-line system identification, FIG. 10 is a diagrammatic view of an in-wire noise cancellation system, FIG. 11 is a diagrammatic view of a multi-channel system, and FIG. 12 is a time analysis of a sampled signal.

DETAILED DESCRIPTION

Figure 1:
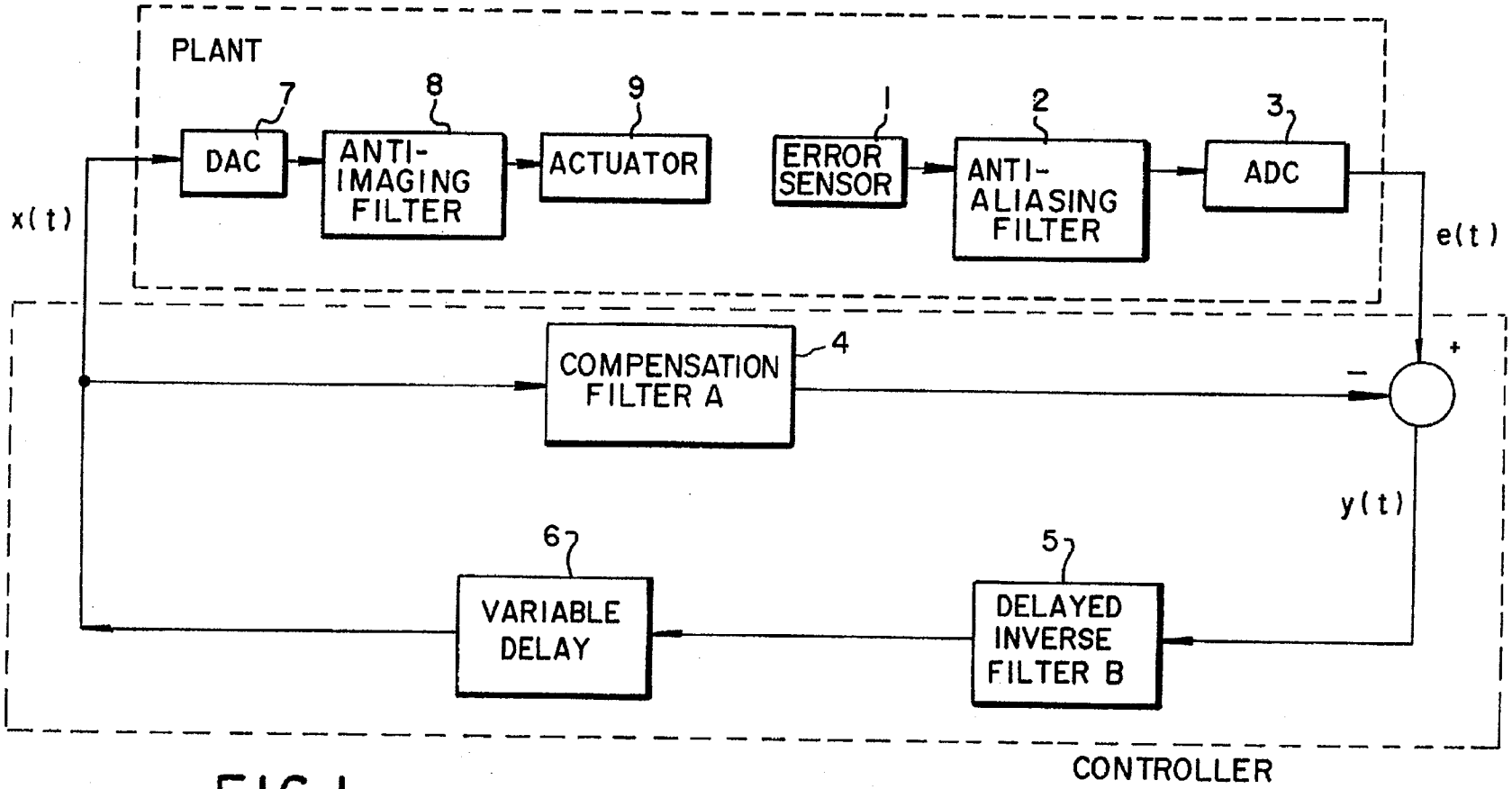

This invention relates to a new type of control system for periodic disturbances. This control system has the following major advantages:

1) The filter is determined by the system to be controlled and so does not have to be adapted to cope with changing disturbances.

2) The filter operates in the time domain, relying only on the periodicity of the noise, and so the computational requirements are independent of the number of harmonic components in the disturbance.

By way of explanation a single channel digital control system will be described first.

The object of the invention is to control an unwanted disturbance. If there were no output from the controller this unwanted disturbance would produce a signal y(t) at the controller input at time t. The controller output at time t is define to be x(t). If the unwanted disturbance is in a physical system rather than an electronic circuit, the controller output is fed to an actuator which produces a counter disturbance which mixes with the unwanted disturbance and results in a residual disturbance. The input to the controller is provided by an error sensor which senses the residual disturbance and produces an error signal e(t) at time t. The relationship between e(t), y(t) and x(t) will now be described for a digital system. The sampling period of the digital system is defined to be T, and the nth sample occurs at time nT. The error signal at time nT, which is denoted by e(nT), is given by $$e(nT)=y(nT)+(A*x)(nT), \tag{1}$$

where A denotes the impulse response of the system between the controller output and the controller input and where * denotes the convolution operator. (A*x)(nT) denotes the convolution of A and x evaluated at time nT which is given by the definition $$(A*\mathrm{n})(nT)=\sum_k A(kT)\cdot x(nT-kT), \tag{2}$$

and where y(nT) is the signal due to the uncanceled disturbance, A(kT) is the response at error sensor at time t=kT due to a unit impulse sent to the actuator at time t=0, and x is the controller output. The system impulse response, A, is known in control literature as the plant response.

For electrical disturbances the signal y is available, for other applications the signal y can be estimated by subtracting of the predicted effect of the controller from the error signal, $$y(nT)=e(nT)-(A*x)(nT), \tag{3}$$

provided that the system impulse response, A, is known. In practice an approximate system model must be used, but we will assume for simplicity of explanation that the actual impulse response and the system model are equivalent and will denote both of them by the symbol A. The convolution of x with A in equation (e) is equivalent to filtering the signal x through a filter with impulse response A. Since the effect of this term is to compensate for the feedback from the controller output to the controller input, the filter A is referred to as a compensation filter.

The ideal output, x, can be obtained by passing the signal y through a filter F, and inverting, so that $$x(nT)=-(F*y)(nT). \tag{4}$$

The filter F is the inverse of A, which in digital form is defined by $$(A*F)(nT)=1 \text{ if } n=0,\ 0 \text{ otherwise}. \tag{5}$$

Unfortunately, the filter F cannot be realized since it must compensate for the delay in the response A.

However, it is often possible to realize a filter B which is the delayed inverse of A with a phase inversion. B is defined by $$(A*B)(nT)=-1 \text{ if } n=m,\ 0 \text{ otherwise}, \tag{6}$$

where mT is referred to as the modeling delay.

We can define a filter D(t) which corresponds to a pure delay of time t. Equation (6) can then be written more compactly as $$A*B=-D(mT). \tag{7}$$

A periodic disturbance is changed very little by delaying it by one noise cycle, so, for a disturbance with period $\tau$, we have $$y(t-\tau)\cong y(t), \tag{8}$$

or, equivalently, $$D(\tau)*y\cong y. \tag{9}$$

The control system utilizes this property of the disturbance.

In one form of the control system, the filter is obtained by combining the filter B and a filter $D(\tau-mT)$ in series. The actuator drive signal is obtained by passing the signal y(t), obtained using equation (3), through this combined filter. The response at the sensor is $$e=y+A*(B*D(\tau-mT))*y. \tag{10}$$

Using the definition (7), it can be seen that the combination A*B*D is equivalent of a pure delay of time $\tau$, hence the residual disturbance is $$\Rightarrow e(t)=y(t)-y(t-\tau). \tag{11}$$

For periodic signals, which satisfy (9), this residual disturbance is small.

If the modeling delay is greater than one period, $\tau$ in equation 10 and the systems described below must be replaced by an integer multiple of the period, $N\tau$, such that $N\tau>mT$.

The basic control system, shown in FIG. 1, consists of feedback loop comprising an error sensor (1), anti-aliasing filter (2), analog-to-digital converter (ADC) (3) (only required if digital filters are to be used), compensation filter (4), a 'delayed inverse' filter, (5), a variable delay (6) with delay $\tau$–mT, digital-to analog converter (DAC) (7) (only required if digital filters are to be used), anti-imaging filter (8), and actuator (9).

The additional delay introduced by variable delay 6 is chosen so that the modeling delay and the additional delay is a whole number of noise cycles. If the cycle length, $\tau$, is not known in advance, or it is subject to variations, the delay must be varied as the period of the noise varies. The period can be measured from the noise itself or from a sensor, such as an accelerometer or tachometer, responsive to the frequency of the source of the noise.

The part of the system from the controller output to the controller input is referred to as the plant. This includes the elements 7, 8, 9, 1, 2, 3 in FIG. 1 as well as the response of the physical system.

The modeling delay is determined by the system to be controlled, and typically must be greater than the delay through the plant.

The additional delay is determined by the modeling delay and the fundamental period of the noise (disturbance).

Unlike previous control systems, delayed inverse filter 5 does not need to vary with the noise.

Figure 4:
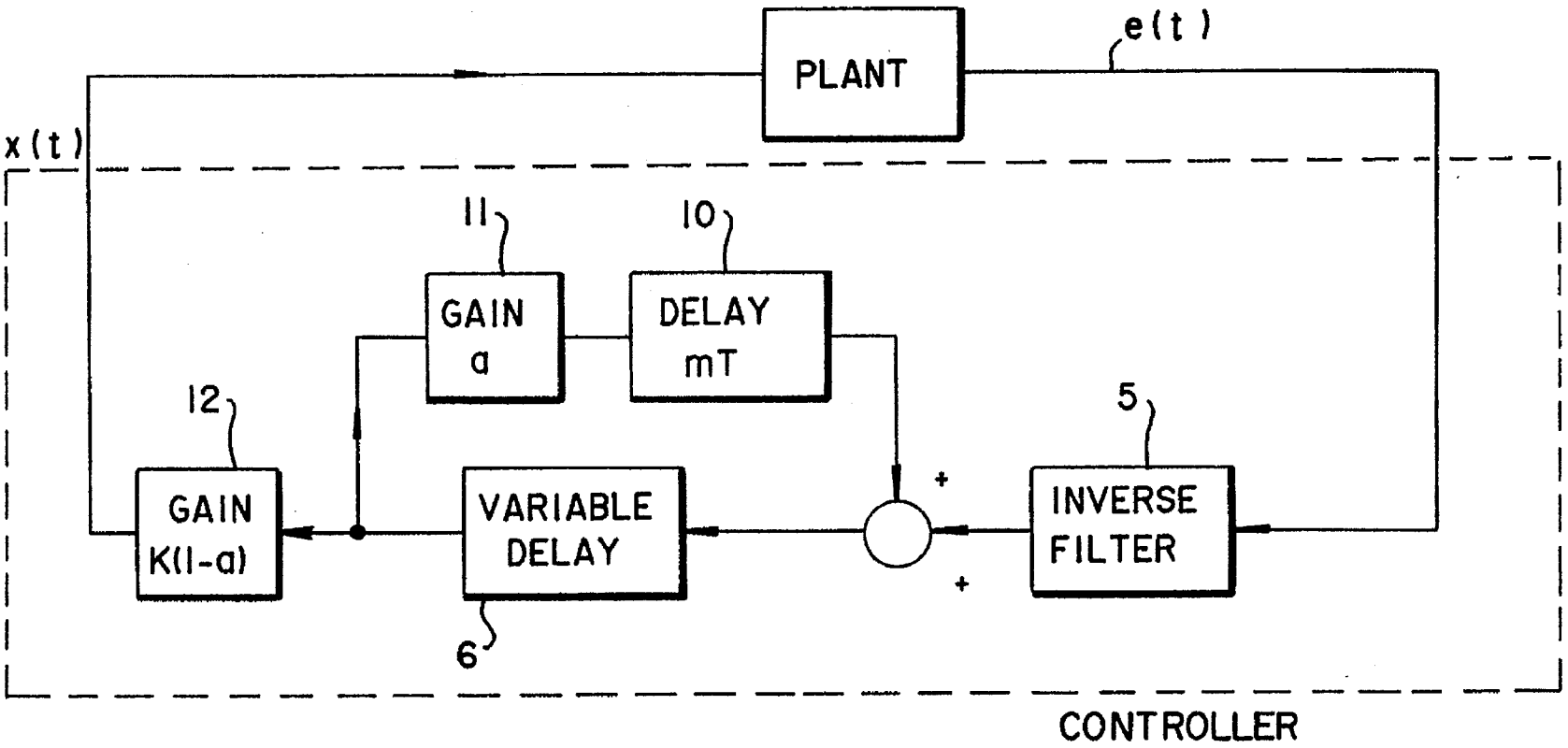

In another form of the controller, shown in FIG. 4, the compensation filter 4(A) can be avoided. In this form, the actuator drive signal from anti-imaging filter 8 is obtained by passing the error signal e(t) through the delayed inverse filter 5(B) and the variable delay 6 D(τ−mT) and then through an additional gain K. (Note that the order of these elements can be interchanged). The response at the sensor is $$e=y+A*K.(B*D)*e. \quad (12)$$

The combination A*B*D is equivalent to a pure delay τ, hence $$=>e(t)=y(t)-K.e(t-\tau). \quad (13)$$

If the error signal is periodic with period τ, (13) can be rearranged to give $$e(t)=y(t)/(1+K). \quad (14)$$

Hence the disturbance is reduced by a factor 1+K.

Disturbances with other periods (other frequencies) may not be reduced and could cause the system to become unstable. This can be avoided by filtering out disturbances which do not have a fundamental period τ.

Figure 2:
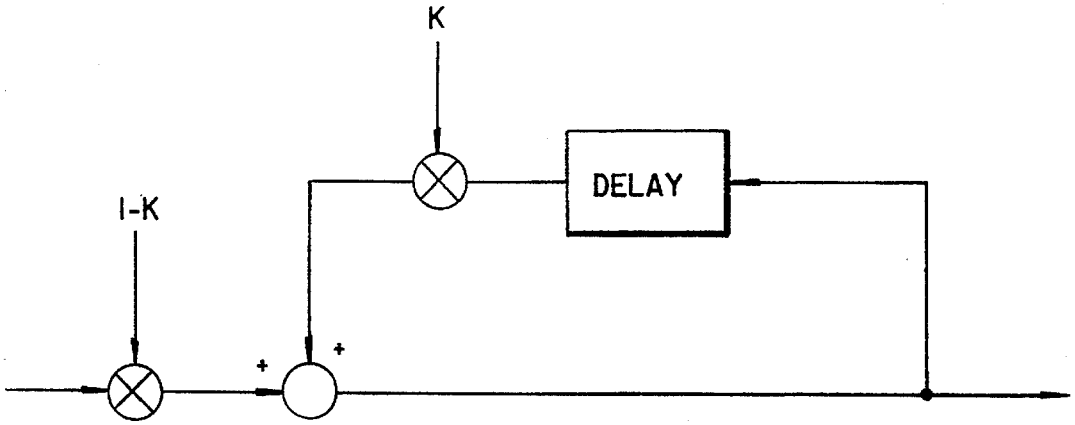
Figure 3:
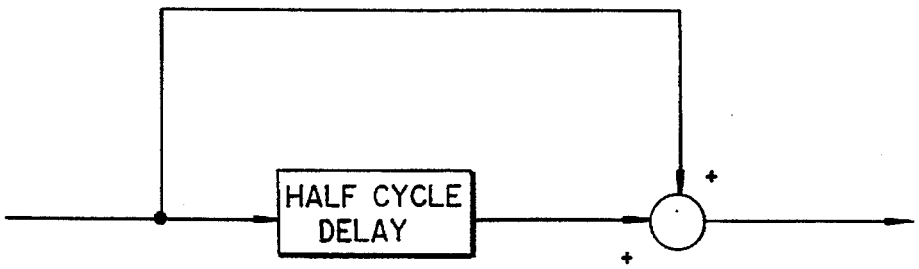

One way of doing this is to use a 'comb filter', which can be positioned at any point in the feedback loop. One example of a comb filter is a positive feedback loop with a one cycle delay around the loop and a loop gain, α, of less than unity. This is shown in FIG. 2. Another example is a feedforward loop with a delay of ½ cycle in one of the paths as shown in FIG. 3.

The full control system is shown in FIG. 4. The plant is shown in FIG. 1. The delay and the comb filter have been combined in this example, so that only a single variable delay is required. The output x from the controller is $$x=D(\tau-mT)(K(1-\alpha)B*e+\alpha D(mT)*x). \quad (15)$$

In the first form of the control system, shown in FIG. 1, the estimate of the uncanceled signal, y, is obtained using equation (3). This signal is then passed through the delayed inverse filter 5(B) to give a signal B*y. This requires the calculation of two convolutions. However, using the relation $$B*y=B*(e-A*x)=B*e-B*A*x=B*e+D(mT)*x, \quad (16)$$

it can be seen that the signal B*y can be calculated via a single convolution and a delay. This require less computation.

The output from the controller is $$x=D(\tau-mT)B*y=D(\tau-mT)(B*e+D(mT)*x), \quad (17)$$

which is very similar to equation (15), since the compensation filter 4 appears as a comb filter 11 in FIG. 4. Formally, the two equations are the same in the limit as loop gain a tends to one with K(1−α)=1.

If an additional comb filter is added to the controller in equation (17), the comb filter and the feedback compensation can be combined. The controller output is then $$x=D(\tau-mT)B*y=D(\tau-mT)((1-\alpha)B*e+D(mT)*x). \quad (18)$$

Figure 5:
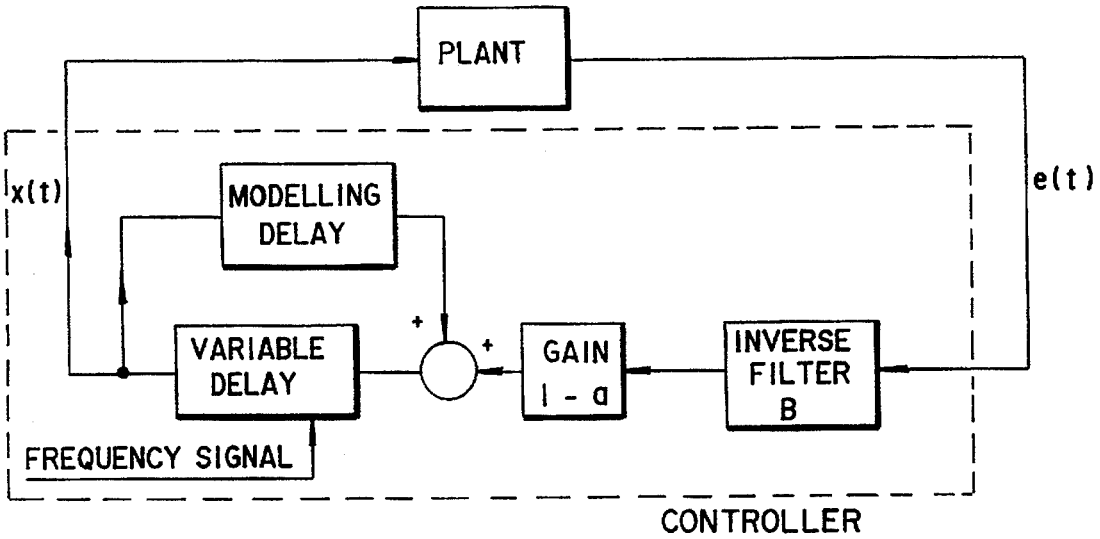

The resulting control system is shown in FIG. 5. In this form of the control system the parameter α determines the degree of selectivity of the controller, α=0 being the least selective and the selectivity increasing as α increases.

There are many known ways of implementing the required delays. One example, which can be used when the sampling frequency is high compared to highest frequency of the disturbance, is to use a digital filter with only two non-zero coefficients. For a delay t=(n+δ)T which is not a whole number of sampling periods, this is equivalent to writing $$D(t)\equiv(1-\delta).D(nT)+\delta.D(nT+T). \quad (19)$$

This can be implemented as digital filter with n-th coefficient 1−δ and (n+1)-th coefficient δ.

Other ways of implementing the required delays include analog and digital delay lines and full digital filters.

The inclusion of a comb filter avoids amplification of the disturbance at non-harmonic frequencies, and also makes the control system selective.

A comb filter can be included in either form of the control system. In the first form shown in FIG. 1 it is only required when selectivity is required, since stability is obtained by use of the compensation filter. In the second form shown in FIG. 4, the filter is necessary to stabilize the feedback loop.

Figure 6:
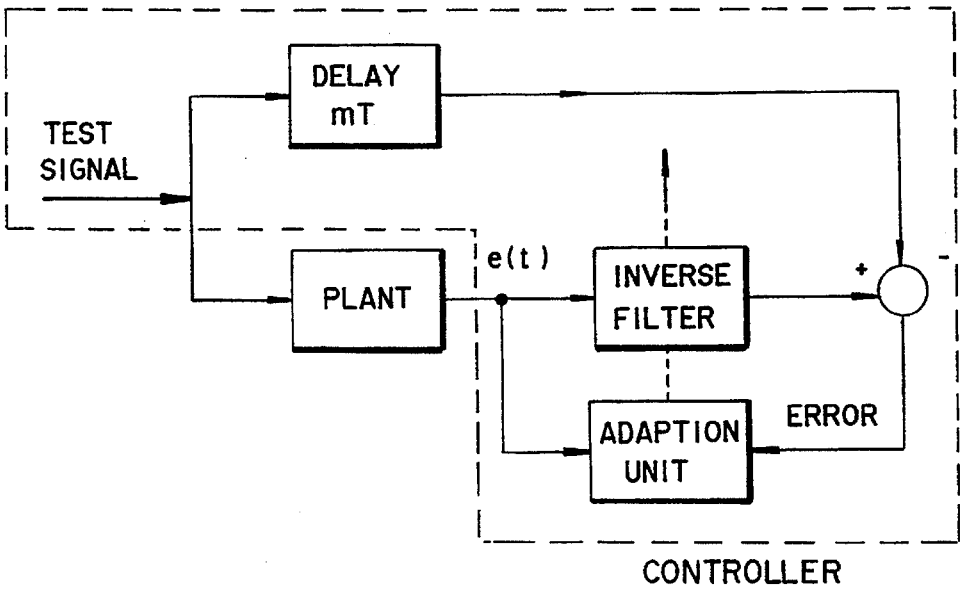
FIG.6 PRIOR ART

There are well known methods for obtaining the delayed inverse filter B. Some of these are described by Widrow and Stearns. An example is shown in FIG. 6. A test signal is supplied to delay mT and the plant (which is shown in FIG. 6). The output signal of the plant is applied to the inverse filter. The difference or error between the output signal of the inverse filter and delay mT is used to adapt the inverse filter. When the filter adaption is complete, the inverse filter will be an approximation to the required delayed inverse filter B, which is a delayed inverse of the system with a phase inversion. The delayed inverse filter can be a combination of finite impulse response filter and a recursive filter.

It is not always possible to obtain a delayed inverse of the system. This happens, for example, when the system cannot be modeled as minimum phase system plus a delay. There are ways of overcoming this problem, one way is to use an extra filter and actuator. This technique is well known in the field of audio processing, where compensation for room acoustics is required, see Miyoshi et al in "Inverse Filtering of Room Acoustics", IEEE Trans Acoustics Speech and Signal Processing, ASSP-36, 145–152 (1988). For application of active control in aircraft and automobile cabins for example, where the reverberation of the cabin make a single channel system difficult to implement, it is likely that multichannel versions of the control system will be used.

Figure 7:
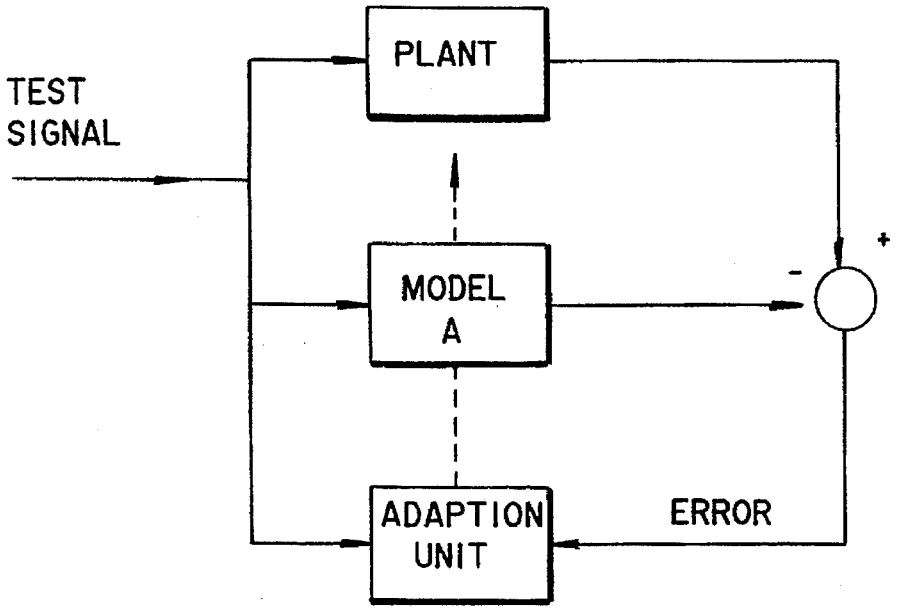
FIG.7 PRIOR ART

For the first form of the control system, shown in FIG. 1, compensation filter, A, is also required. Again, there are well known techniques for identifying a model of A. One example is shown in FIG. 7. A test signal is sent to the actuator shown as part of the plant and through an adaptive filter comprised of Model A and the adaption unit. The response at the sensor is compared to the output of the adaptive filter and any difference is used to adapt the filter.

Figure 8:
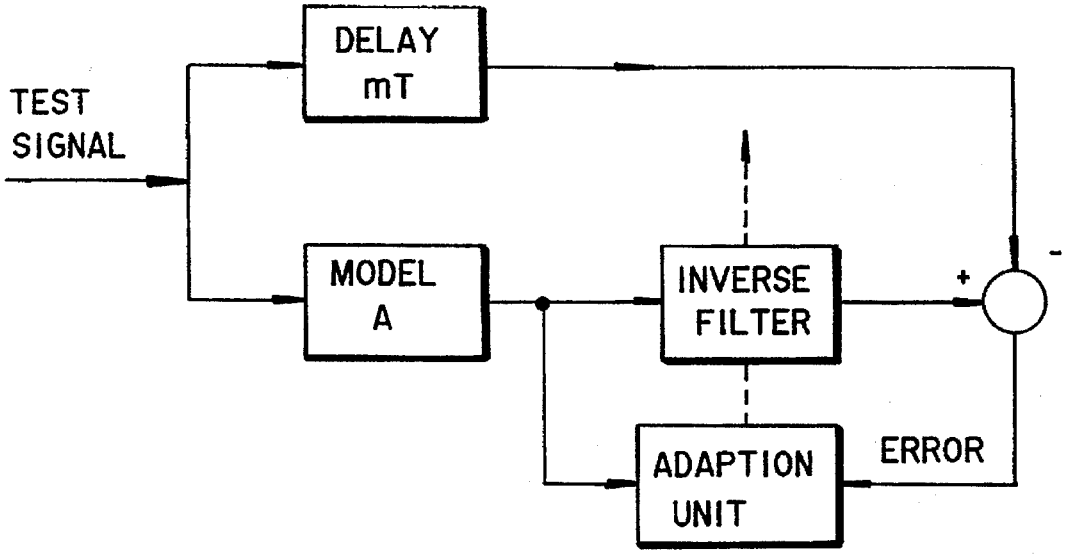

Once the filter A is known, the filter B can be determined as in FIG. 8. This is equivalent to FIG. 6 except that the actual system has been replaced by the model of the system. Alternatively, the filter B can be calculated using Wiener Filtering Theory. This approach is useful when the frequency bandwidth of the noise is limited, or when an exact inverse is not achievable (because of finite filter length or non-minimum phase effects).

In some applications, the system response may change slowly over time. In these applications it is necessary to change the filters A and B.

One way of doing this is to turn off the control system and remeasure the responses. Alternatively, there are some well known techniques for identifying A 'on-line', i.e. while the control system is still in operation. For example, a low-level test signal can be added to the controller output. The difference between the actual sensor response and the predicted response can be used to adapt the model of A, provided that the test signal is uncorrelated with the original noise.

The filter B may then be updated 'off-line' using the model of A, as in FIG. 8.

Figure 9:
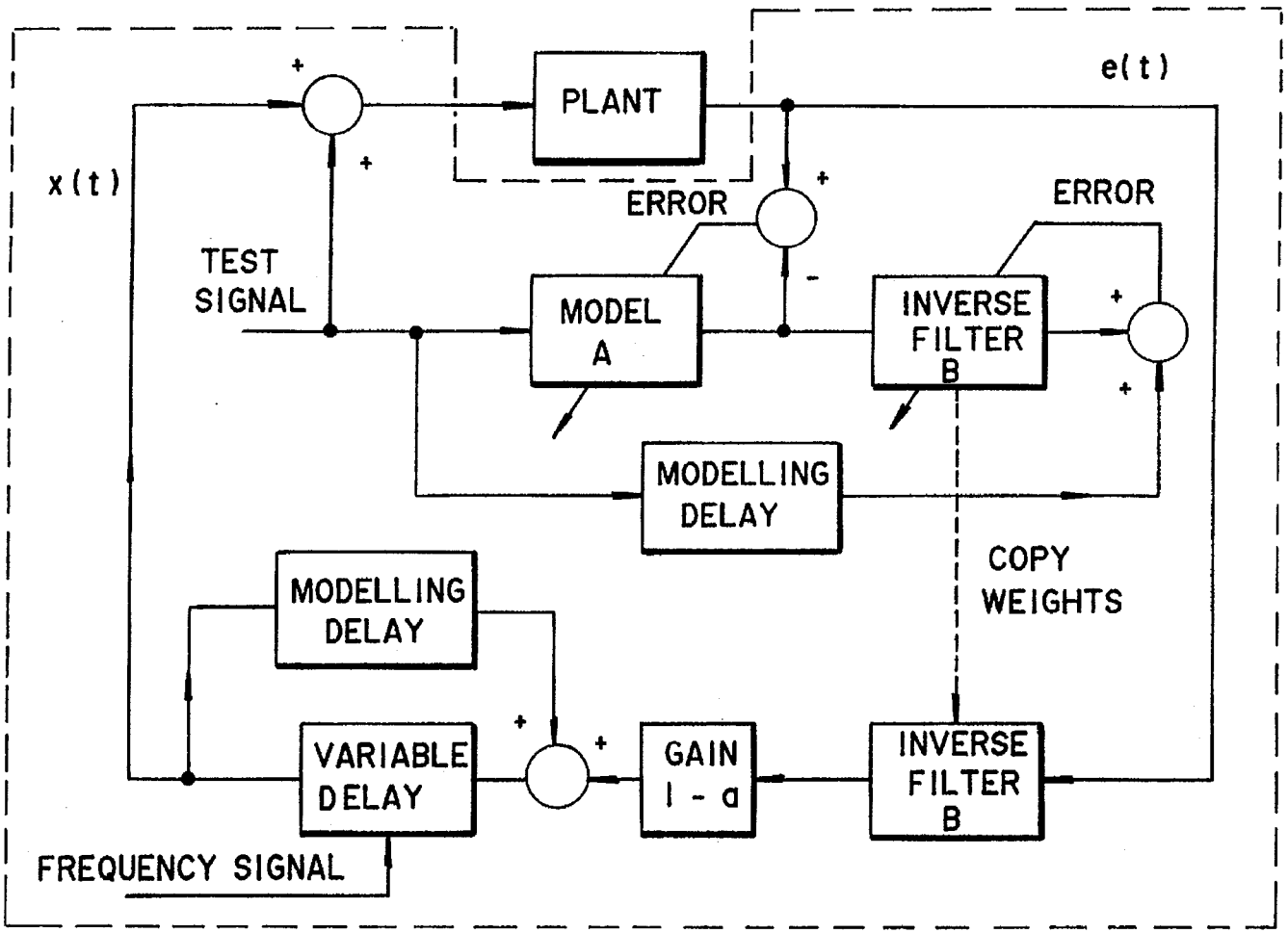

An example of a complete control system, including on-line system identification, is shown in FIG. 9.

The control loop part of the system is the same as shown in FIG. 5. The on-line system identification system is driven by a random test signal. This test signal is added to the output signal x(t) and the combined signal is sent to the plant. The difference between the output from the plant (error signal e(t)) and the output from the filter Model A is used to adapt the filter Model A. The output from the filter Model A is passed through inverse filter B The resulting output is then compared with a delayed test signal, which is obtained by passing the test signal through a modeling delay, and the error is used to adapt the filter weights of the inverse filter B. These coefficients are then copied to the inverse filter B in the control loop.

Alternatively, the filter B can itself be treated as an adaptive filter. There are many methods for performing the adaption as described in the Widrow publication, for example, one way is the 'filtered-input LMS' algorithm. In this approach the input to the filter is passed through a model of the response of the rest of the system (including the variable delay and comb filter if present) and then correlated with the error signal to determine the required change to the filter. This will only provide information at frequencies which are harmonic multiples of the fundamental frequency of the noise. However, in some applications, them are more harmonics in the noise than there are coefficients in the filter. In these cases there is sufficient information to update all of the coefficients.

Figure 10:
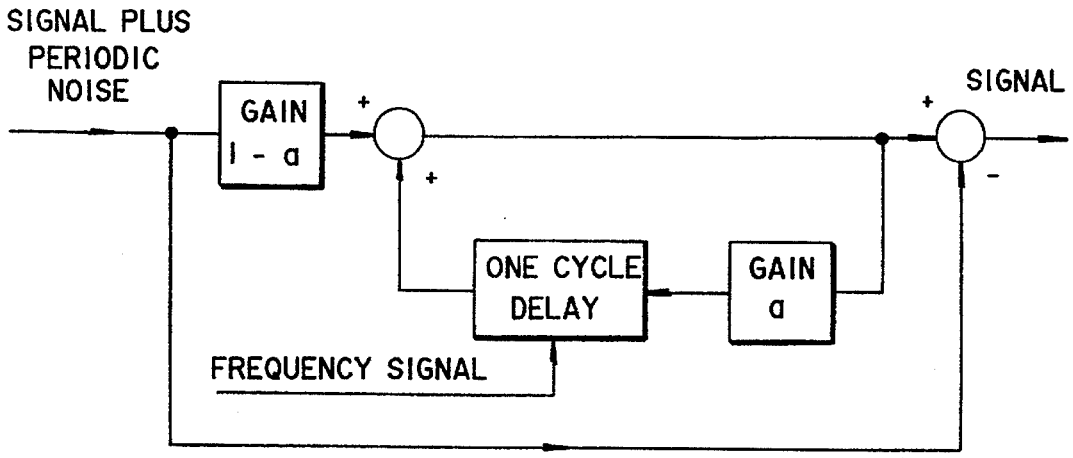

In some applications, the disturbance is in an electrical signal, such as a communication signal. In this case the system response is typically a pure delay (plus some gain factor). The delayed inverse filter, B, is then also a pure delay, and the whole system consists just of a fixed delay and a variable delay as shown in FIG. 10.

Figure 11:
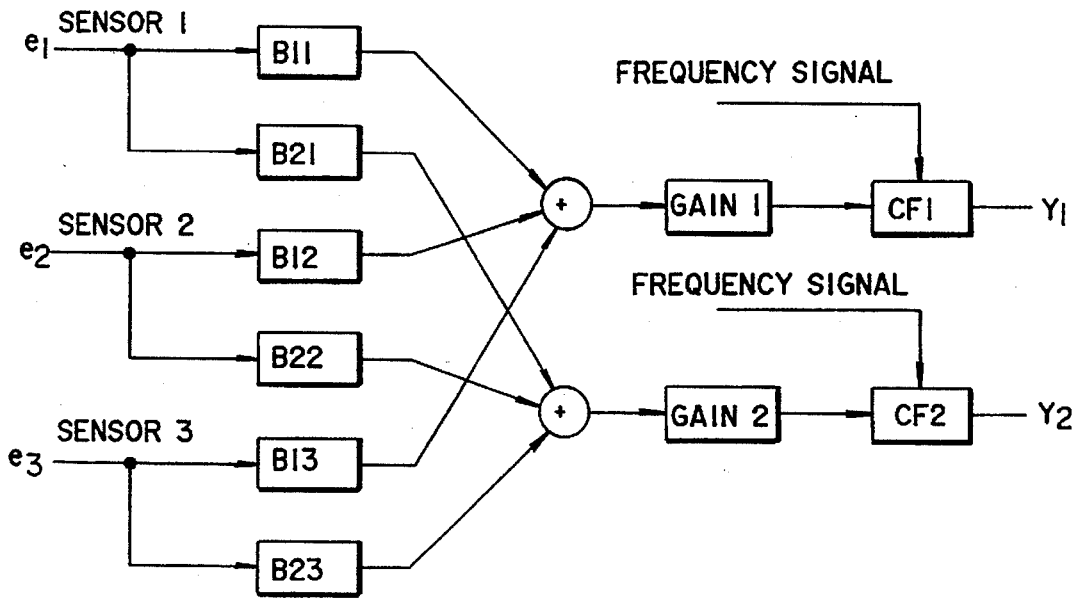

The extension of the system to multiple interacting channels will be obvious to those skilled in the art. An example of a multichannel system with three inputs and two outputs is shown in FIG. 11. One inverse filter, $B_{ij}$, is required for each pair of interacting sensor and actuator, whereas only one comb filter (or variable delay unit) is required for each output channel (CF1 and CF2 in the figure). The comb filters could be applied to the input channels instead, but often there are more inputs than outputs in which case this would result in a more complex control system.

The input signal to the i-th comb filter passed through a gain block and is $$r_i = \sum_j B_{ij} * e_j \tag{20}$$

where $e_j$ is the signal from the j-th sensor and $B_{ij}$ is the appropriate inverse filter.

The output from the i-th channel is $$Y_i = (1-\alpha)D(mT)*r_i + D(\tau)*Y_i \tag{21}$$

The filters $A_{ij}$ which model the system response can be found in the same way as the single channel filters by driving the output channels in turn with a test signal. Alternatively, all of the channels can be driven simultaneously with independent (uncorrelated) signals.

Once the filters $A_{ij}$ have been identified, there are a variety of ways in which the filters $B_{ij}$ can be obtained. These include time domain approaches, such as Weiner filtering, and frequency domain approaches.

Alternatively, the filters $B_{ij}$ can be obtained directly by adaptive filtering using the multichannel Least Mean Square algorithm, for example.

The other single channel systems described above can also be implemented as multichannel systems.

Reduction to practice

Figure 12:
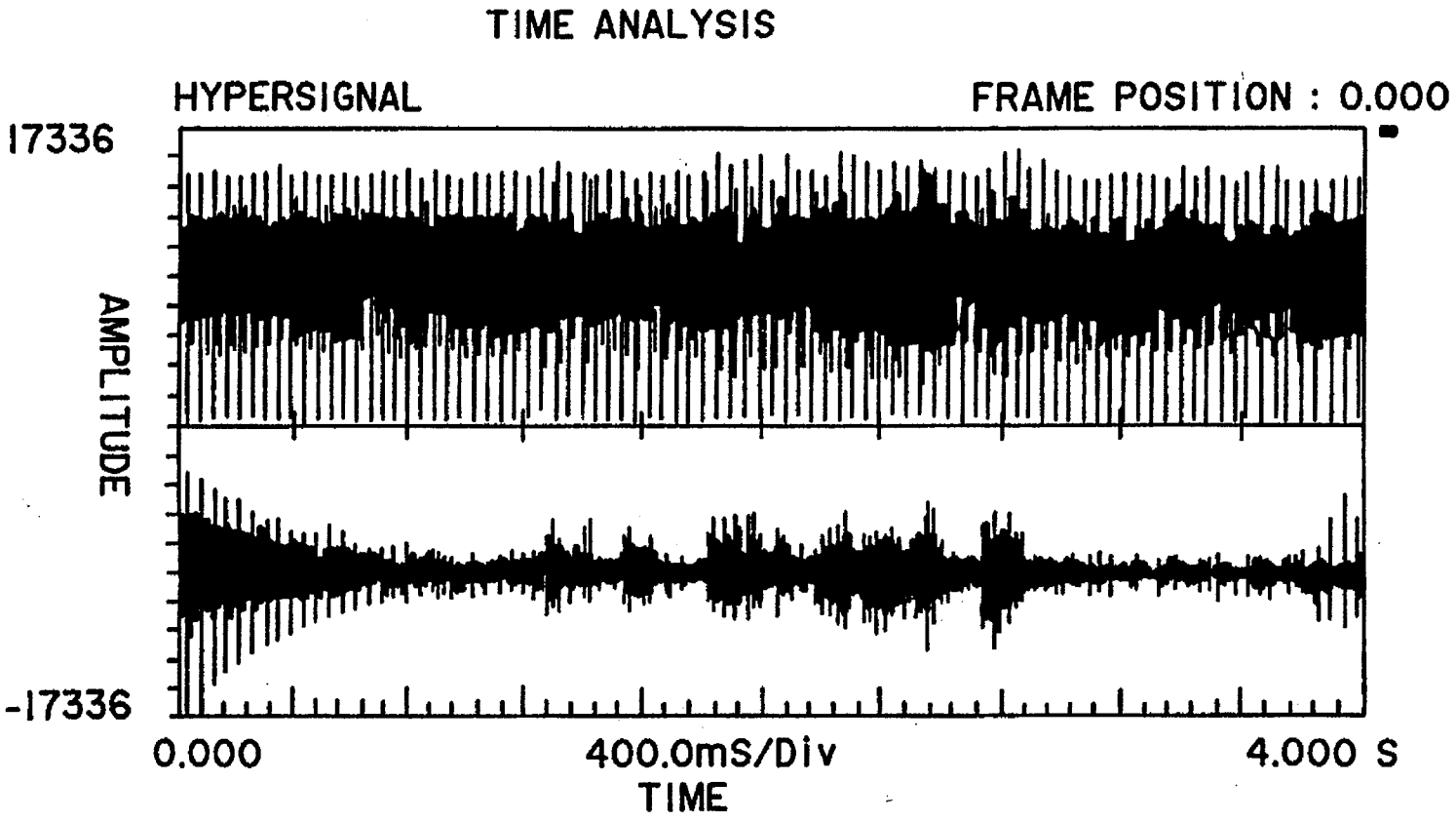

The effectiveness of the control system has been demonstrated on the selective filtering of a periodic noise from a communications signal. In this example the communications microphone is in the vicinity of a loud periodic noise source and, untreated, the speech cannot be heard above the noise. The time trace of the untreated signal is shown in the upper plot in FIG. 12.

The treated signal is shown in the lower plot, and the speech signal can be clearly seen (and heard) above the reduced noise level. The noise level decays exponentially when the system is first turned on since the canceling signal must pass around the control loop several times for the response to build up.

While only one preferred embodiment of the invention has been shown and described, it will be obvious to those of ordinary skill in the art that many changes and modifications can be made without departing from the scope of the appended claims.

I claim:

1. A method for attenuating an initial periodic disturbance in a physical system utilizing a two component disturbance signal control system, said method comprising the steps of:

generating a counter disturbance in response to a control signal;

sensing a residual disturbance within said physical system which is defined as being a combination of the initial periodic disturbance and the counter disturbance to produce an error signal related to the residual disturbance;

passing the error signal, or a first signal derived from the error signal, through a control circuit comprising an inverse filter means and a first delay means coupled together in a series arrangement so as to produce said control signal, wherein said inverse filter means provides an output with a fixed delay representative of an inverse modeling delay of the physical system, said first delay means has a first delay time which is dependent upon the period of the initial periodic disturbance and to the fixed modeling delay, and whereby the counter disturbance attenuates the initial periodic disturbance.

2. A method as in claim 1, wherein the first delay time is adjusted so that the sum of the first delay time and the fixed modeling delay is equal to an integer multiple of the period of said initial periodic disturbance.

3. A method as in claim 2 and including the additional step of continually measuring the period of the initial periodic disturbance and readjusting the first delay time based on the step of continually measuring the period of the initial periodic disturbance.

4. A method as in claim 3 wherein the period of the initial periodic disturbance is determined from the first signal or the control signal.

5. A method as in claim 1 including the additional steps of:

passing said control signal through a feedback compensation filter to provide a second signal which approximates a portion of the error signal due to said counter disturbance, and subtracting said second signal from said error signal to produce said first signal.

6. A method as in claim 1 and including the additional step of passing either said control signal or said error signal through a comb filter so as to only control those disturbances having the period of the initial periodic disturbance.

7. A method as in claim 6 including the initial step of amplifying said error signal or said control signal.

8. A method as in claim 6 wherein said comb filter is implemented by:

delaying said control signal by an amount equal to the fixed modeling delay to produce a delayed control signal; and adding said delayed control signal to an input of said first delay means.

9. A control system for attenuating an initial periodic disturbance in a physical system, said control system comprising:

means to generate a counter disturbance in response to a control signal, means to sense a residual disturbance within said physical system which is defined as being a combination of the initial periodic disturbance and the counter disturbance and produce an error signal related to the residual disturbance, and a control circuit, comprising an inverse filter means and a first delay means coupled together in a series arrangement, having a first signal derived from the error signal, as an input signal and producing the control signal as an output signal, wherein said inverse filter means provides an output with a fixed delay representative of an inverse modeling delay of the physical system, wherein said first delay means has a first delay time which is dependent upon a period of the initial periodic disturbance and to the fixed modeling delay, and whereby the counter disturbance attenuates the initial periodic disturbance, wherein said control signal is passed through a feedback compensation filter means which produces a second signal which approximates a portion of the error signal due to said counter disturbance, and means to subtract said second signal from said error signal to produce said first signal, wherein adjustment means adjust the first delay time so that the sum of the first delay time and the fixed modeling delay is equal to an integer multiple of the period of said initial periodic disturbance.

10. A system as in claim 9 wherein the adjusting means further includes means for continually measuring the period of the initial periodic disturbance and readjusting the first delay time based on the step of continually measuring the period of the initial periodic disturbance.

11. A system as in claim 10 wherein the period of the initial periodic disturbance is determined from the first signal or the control signal.

12. A control system for attenuating an initial periodic disturbance in a physical system, said control system comprising:

means to generate a counter disturbance in response to a control signal, means to sense a residual disturbance within said physical system which is defined as being a combination of the initial periodic disturbance and the counter disturbance and produce an error signal related to the residual disturbance, a control circuit, comprising an inverse filter means and a first delay means coupled together in a series arrangement, having the error signal as an input signal and producing the control signal as an output signal, wherein said inverse filter means provides an output with a fixed delay representative of an inverse modeling delay of the physical system, wherein said first delay means has a first delay time which is dependent upon a period of the initial periodic disturbance and to the fixed modeling delay, and whereby the counter disturbance attenuates the initial periodic disturbance, and a comb filter means through which either said control signal or said error signal is passed so as to only control those disturbances having the period of the initial period disturbance, wherein the comb filter means is connected in series with the inverse filter means and the first delay means.

13. A system as in claim 12 including amplification means for amplifying said error signal or said control signal, wherein the amplification means is connected in series with the inverse filter means and the first delay means.

14. A system as in claim 12 wherein said comb filter means delays said control signal by an amount equal to the fixed modeling delay to produce a delayed control signal and adds said delayed control signal to an input of said first delay means.

15. A system as in claim 12, wherein adjustment means adjust the first delay time so that the sum of the first delay time and the fixed modeling delay is equal to an integer multiple of the period of said initial periodic disturbance.

16. A system as in claim 15, wherein the adjusting means further includes means for continually measuring the period of the initial periodic disturbance and readjusting the first delay time based on the step of continually measuring the period of the initial periodic disturbance.

17. A system as in claim 16, wherein the period of the initial periodic disturbance is determined from the first signal or the control signal.

* * * * *